US010252330B2

(12) United States Patent
Zhang et al.

(10) Patent No.: US 10,252,330 B2
(45) Date of Patent: Apr. 9, 2019

(54) POURING METALLIC PLUG STICK CLAMPING MECHANISM FOR CAST STEEL WHEELS

(71) Applicant: Amsted Rail Company, Inc., Chicago, IL (US)

(72) Inventors: Sijin Zhang, Xinyang (CN); Xuefeng Yu, Datong (CN); James Harold Strickland, Chicago, IL (US); Chengqun Yan, Xinyang (CN); Zhongxian Du, Xinyang (CN); Changling Hu, Xinyang (CN)

(73) Assignee: Amsted Rail Company, Inc., Chicago, IL (US)

( * ) Notice: Subject to any disclaimer, the term of this patent is extended or adjusted under 35 U.S.C. 154(b) by 111 days.

(21) Appl. No.: 15/406,990

(22) Filed: Jan. 16, 2017

(65) Prior Publication Data

US 2017/0203360 A1 Jul. 20, 2017

(30) Foreign Application Priority Data

Jan. 10, 2016 (CN) ..... 2016 2 0028528 U

(51) Int. Cl.

| | |
|---|---|
| ***B22D 41/20*** | (2006.01) |
| ***B22D 37/00*** | (2006.01) |
| ***B22D 41/18*** | (2006.01) |
| ***B22D 39/00*** | (2006.01) |

(52) U.S. Cl.

CPC ..... *B22D 41/20* (2013.01); *B22D 37/00* (2013.01); *B22D 39/00* (2013.01); *B22D 41/18* (2013.01)

(58) Field of Classification Search

CPC ..... B22D 37/00; B22D 39/00; B22D 41/18; B22D 41/20

USPC ..... 266/272, 236, 271; 222/590, 591, 597, 222/598; 164/335, 337, 136, 155.1, 164/155.5, 155.3, 325, 326, 437

See application file for complete search history.

(56) References Cited

U.S. PATENT DOCUMENTS

| | | | | | |
|---|---|---|---|---|---|
| 4,877,221 | A * | 10/1989 | Scriven | C21B 7/12 | 266/271 |
| 4,953,761 | A * | 9/1990 | Fishman | B22D 41/20 | 164/337 |
| 5,118,084 | A * | 6/1992 | Paulus | B22D 41/20 | 266/236 |
| 5,303,905 | A * | 4/1994 | Pohl | B22D 41/18 | 222/597 |
| 7,959,853 | B2 * | 6/2011 | Payne | B22D 41/18 | 222/602 |

* cited by examiner

*Primary Examiner* — Jessee R Roe
*Assistant Examiner* — Michael Aboagye
(74) *Attorney, Agent, or Firm* — Harness, Dickey & Pierce, P.L.C.

(57) ABSTRACT

A pouring metallic plug stick clamping mechanism for cast steel wheels. The mechanism includes: a cast iron frame, a plurality of grooves, a centrally located opening in the frame, a first white ceramic ball, a second white ceramic ball, a third white ceramic ball, a retaining spring, a pressure regulating bolt, a control press button, a metallic plug stick, and a blocking iron piece.

4 Claims, 1 Drawing Sheet

POURING METALLIC PLUG STICK CLAMPING MECHANISM FOR CAST STEEL WHEELS

CROSS-REFERENCE TO RELATED APPLICATION

Figure 1:
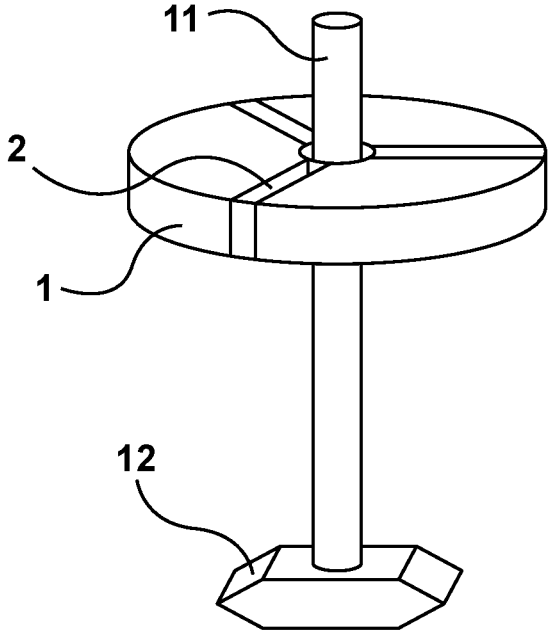

This application claims the benefit and priority of Chinese Patent Application Serial No. 201620028528.4 filed Jan. 10, 2016, the entire disclosure of which is incorporated herein by reference.

FIELD

The present invention relates to the field of a clamping apparatus, and specifically to a pouring metallic plug stick clamping mechanism for cast steel wheels.

BACKGROUND

This section provides background information related to the present disclosure which is not necessarily prior art.

During operation of an apparatus, it may be required to fix an object to be processed or a device in proper position for processing or testing. In a pouring metallic plug stick clamping mechanism for cast steel wheels, the traditional metallic plug stick of the clamping mechanism is prone to drop to a wrong position during movement of the graphite flask. As the insulating property is poor, the plug stick can move downwards with an external force applied but cannot rapidly block the pouring passage, the plug stick is not easy for assembling, and the clamping mechanism cannot be used repeatedly, thus significantly decreasing the working efficiency.

SUMMARY

This section provides a general summary of the disclosure, and is not a comprehensive disclosure of its full scope or all of its features.

The objective of the present invention is to provide a pouring metallic plug stick clamping mechanism for cast steel wheels, so as to solve the problem(s) as mentioned in the above background technology.

In order to achieve the above objective, a technical solution is provided in the present invention as follows: a pouring metallic plug stick clamping mechanism for cast steel wheels, comprising: a cast iron frame, a plurality of grooves, a centrally located opening in the frame, a first white ceramic ball, a second white ceramic ball, a third white ceramic ball, a retaining spring in at least one of the grooves, a pressure regulating bolt, a control press button, a metallic plug stick, and a blocking iron piece, wherein the grooves are provided in the cast iron frame and extend radially outwardly from the opening, the first white ceramic ball, the second white ceramic ball and the third white ceramic ball being mounted in the grooves, the retaining spring is mounted on the first white ceramic ball, the pressure regulating bolt is mounted on the retaining spring, the control press button is mounted on the pressure regulating bolt, the metallic plug stick passes through the opening in the cast iron frame and is fixed at its lower end to the blocking iron piece.

Preferably, the cast iron frame has a thickness of about 5 cm and is entirely inlaid in an upper graphite flask.

Preferably, the metallic plug stick is in contact with only the first white ceramic ball, the second white ceramic ball and the third white ceramic ball.

Preferably, each of the first white ceramic ball, the second white ceramic ball and the third white ceramic ball is provided thereon with the retaining spring and the pressure regulating bolt.

Preferably, there are three grooves, with an angle of 120° therebetween.

Compared with the prior art, the present invention may have the following beneficial effects: in the mechanism, with the retaining spring applied, the white ceramic balls clamp the metallic plug stick tightly to prevent the metallic plug stick from dropping during movement; the metallic plug stick is in contact with only the three white ceramic balls such that the metallic plug stick is absolutely insulated. The mechanism is reliable for repeated use for long term and the plug stick is easy for assembling, and it passes the testing to meet various use requirements.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
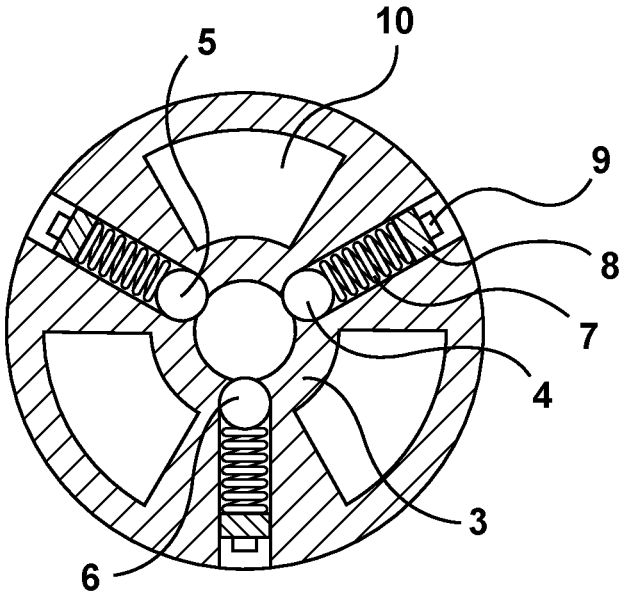

FIG. 1 is a perspective view of the pouring metallic plug stick clamping mechanism according to an embodiment of the present invention; and FIG. 2 is a top cutaway view of the cast iron frame of the pouring metallic plug stick clamping mechanism according to an embodiment of the present invention.

DETAILED DESCRIPTION

Example embodiments will now be described more fully with reference to the accompanying drawings.

Hereinafter, the technical solutions in the embodiments of the present invention will be described clearly and completely, in connection with the accompanying drawings in the embodiments of the present invention. The described embodiments are only example embodiments of the present invention, not all the possible embodiments. Any other embodiments obtained by those skilled in the art, based on the embodiment of the present invention and without any inventive work, will fall within the protection scope of the present invention.

Referring to FIGS. 1 and 2, in the present invention, a technical solution is described as follows: a pouring metallic plug stick clamping mechanism for cast steel wheels includes a cast iron frame 1, three radially outwardly extending grooves 2, a centrally located opening 3 in the frame, a first white ceramic ball 4, a second white ceramic ball 5, a third white ceramic ball 6, a retaining spring 7, a pressure regulating bolt 8, a control press button 9, a sector shaped panel 10, a metallic plug stick 11, and a blocking iron piece 12, wherein the grooves 2 are provided on the cast iron frame 1 and extend radially outward from the opening 3. The first white ceramic ball 4, the second white ceramic ball 5 and the third white ceramic ball 6 being mounted in the grooves 2. The metallic plug stick 11 may also be referred to as a stopper shaft. As well, the white ceramic balls 4, 5 and 6 may also be referred to as ceramic balls 4, 5 and 6 and may be of any colour. As shown in FIGS. 1 and 2, the metallic plug stick 11 is in contact with only the first white ceramic ball 4, the second white ceramic ball 5 and the third white ceramic ball 6, thus the metallic plug stick is absolutely insulated from an upper graphite flask, ensuring that the signal detecting channel will not be disturbed. As shown in FIGS. 1 and 2, the retaining spring 7 is mounted on the first white ceramic ball 4, the pressure regulating bolt 8 is mounted on the retaining spring 7, the control press button 9 is mounted on the pressure regulating bolt 8, the sector shaped panel 10 is provided within the cast iron frame 1, the metallic plug stick 11 passes through the opening 3 in the cast iron frame 1 and is fixed at its lower end to the blocking iron piece 12.

The working principle of the pouring metallic plug stick clamping mechanism for cast steel wheels of the present invention is described below. The cast iron frame 1 has a thickness of about 5 cm and is entirely inlaid in an upper graphite flask. The metallic plug stick 11 passes, by an external force, through a gap between the first white ceramic ball 4, the second white ceramic ball 5 and the third white ceramic ball 6. With the retaining spring 7 applied, the white ceramic balls clamp the metallic plug stick 11 tightly on the upper graphite flask, with the clamping force adjustable by the pressure regulating bolt 8, to prevent the metallic plug stick 11 from falling off during movement of the flask. As the metallic plug stick 11 is in contact with only the three white ceramic balls and is suspended in the upper graphite flask, the metallic plug stick 11 is absolutely insulated from the upper graphite flask, ensuring that the signal detecting channel will not be disturbed. When it is needed for the metallic plug stick 11 to fall down, an external force (which may be produced for example by a gas cylinder) may be applied on the top end of the metallic plug stick 11, and the plug stick can move downwards rapidly to block the pouring passage. The mechanism is reliable for repeated use for long term and the plug stick is easy for assembling, and it passes the testing to meet various use requirements.

The embodiments described above are example embodiments of the present invention and are set forth only for illustration of the present invention, rather than making limitation to the present invention in any form. Any equivalent embodiment with a partial variation or modification, which does not depart from the technical feature contents of the present invention, made by those skilled in the art based on the technical contents disclosed in the present invention and without departing from the scope of the technical features as provided in the present invention, will fall within the scope of the technical features of the present invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A pouring metallic plug stick clamping mechanism for cast steel wheels, comprising:

a cast iron frame, a plurality of grooves, a centrally located opening in the frame, a first white ceramic ball, a second white ceramic ball, a third white ceramic ball, a retaining spring in at least one of the grooves, a pressure regulating bolt, a control press button, a metallic plug stick, and a blocking iron piece;

wherein:

the grooves are provided in the cast iron frame and extend radially outwardly from the opening the first white ceramic ball, the second white ceramic ball, and the third white ceramic ball being mounted in the grooves;

wherein each of the first white ceramic ball, the second white ceramic ball and the third white ceramic ball is provided thereon with the retaining spring and the pressure regulating bolt and the metallic plug stick passes through the opening in the cast iron frame and is fixed at its lower end to the blocking iron piece.

2. The pouring metallic plug stick clamping mechanism for cast steel wheels according to claim 1, wherein the cast iron frame has a thickness of about 5 cm.

3. The pouring metallic plug stick clamping mechanism for cast steel wheels according to claim 1, wherein the metallic plug stick is in contact with only the first white ceramic ball, the second white ceramic ball and the third white ceramic ball.

4. The pouring metallic plug stick clamping mechanism for cast steel wheels according to claim 1, wherein there are three grooves, with an angle of 120° therebetween.

* * * * *